US006154926A

United States Patent [19]

Formiller

[11] Patent Number: 6,154,926

[45] Date of Patent: Dec. 5, 2000

[54] REINFORCING DEVICE

[76] Inventor: Walter J. Formiller, 18156 Brown St., Perris, Calif. 92570

[21] Appl. No.: 09/186,416

[22] Filed: Nov. 5, 1998

[51] Int. Cl.[7] ..... E05C 21/00

[52] U.S. Cl. ..... 16/382; 16/389; 16/392; 49/389

[58] Field of Search ..... 16/382, 389, 387, 16/390, 392, 221; 49/399, 382, 460

[56] References Cited

U.S. PATENT DOCUMENTS

| | | | |
|---|---|---|---|
| 518,309 | 4/1894 | Deming | 16/392 |
| 540,646 | 6/1895 | Deming | 16/392 |
| 1,105,666 | 8/1914 | Johnson | 16/389 |
| 2,853,162 | 9/1958 | David et al. | 16/250 |
| 3,690,037 | 9/1972 | Kempel | 49/399 |
| 4,304,027 | 12/1981 | DiFazio | 16/249 |
| 4,438,597 | 3/1984 | Maggart | 49/399 |
| 4,771,506 | 9/1988 | Allen | 16/392 |
| 4,825,509 | 5/1989 | Mitchell et al. | 16/382 |
| 5,193,308 | 3/1993 | Davidian | 16/382 |

*Primary Examiner*—B. Dayoan
*Assistant Examiner*—Mark Williams

[57] ABSTRACT

A new reinforcing device for reinforcing the union of a metal door jamb (or frame) and a hinge of an attached door for helping prevent the bending and breaking of the door jamb and the sagging of the door from the weight of the door, especially on a metal door jamb. The inventive device includes a plate having front and back surfaces, a pair of opposite ends, and a pair of sides extending between the ends. The plate has a plurality of spaced apart holes extending therethrough between the front and back surfaces. The holes are adapted for coaxial alignment with corresponding fastener holes of a leaf of a hinge. The plate is adapted for attachment to a structure over a leaf of a hinge fastened to the structure such that the leaf of the hinge is interposed between the structure and the plate.

6 Claims, 4 Drawing Sheets

REINFORCING DEVICE

BACKGROUND OF THE INVENTION

1. Field of the Invention

The present invention relates to door jamb reinforcing devices and more particularly pertains to a new reinforcing device for reinforcing the union of a metal door jamb (or frame) and a hinge of an attached door for helping prevent the bending and breaking of the door jamb and the sagging of the door from the weight of the door, especially on a metal door jamb.

2. Description of the Prior Art

The use of door jamb reinforcing devices is known in the prior art. More specifically, door jamb reinforcing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,031,946; U.S. Pat. No. 4,344,253; U.S. Pat. No. 2,717,064; U.S. Pat. No. 3,825 291; U.S. Pat. No. 4,629,231; and U.S. Pat. No. 2,981,090.

While these devices fulfill their respective, particular objectives and requirements, the aforementioned patents do not disclose a new reinforcing device. The inventive device includes a plate having front and back surfaces, a pair of opposite ends, and a pair of sides extending between the ends. The plate has a plurality of spaced apart holes extending therethrough between the front and back surfaces. The holes are adapted for coaxial alignment with corresponding fastener holes of a leaf of a hinge. The plate is adapted for attachment to a structure over a leaf of a hinge fastened to the structure such that the leaf of the hinge is interposed between the structure and the plate.

In these respects, the reinforcing device according to the present invention substantially departs from the conventional concepts and designs of the prior art, and in so doing provides an apparatus primarily developed for the purpose of reinforcing the union of a metal door jamb (or frame) and a hinge of an attached door for helping prevent the bending and breaking of the door jamb and the sagging of the door from the weight of the door, especially on a metal door jamb.

SUMMARY OF THE INVENTION

In view of the foregoing disadvantages inherent in the known types of door jamb reinforcing devices now present in the prior art, the present invention provides a new reinforcing device construction wherein the same can be utilized for reinforcing the union of a metal door jamb (or frame) and a hinge of an attached door for helping prevent the bending and breaking of the door jamb and the sagging of the door from the weight of the door, especially on a metal door jamb.

The general purpose of the present invention, which will be described subsequently in greater detail, is to provide a new reinforcing device apparatus and method which has many of the advantages of the door jamb reinforcing devices mentioned heretofore and many novel features that result in a new reinforcing device which is not anticipated, rendered obvious, suggested, or even implied by any of the prior art door jamb reinforcing devices, either alone or in any combination thereof.

To attain this, the present invention generally comprises a plate having front and back surfaces, a pair of opposite ends, and a pair of sides extending between the ends. The plate has a plurality of spaced apart holes extending therethrough between the front and back surfaces. The holes are adapted for coaxial alignment with corresponding fastener holes of a leaf of a hinge. The plate is adapted for attachment to a structure over a leaf of a hinge fastened to the structure such that the leaf of the hinge is interposed between the structure and the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reinforcing device apparatus and method which has many of the advantages of the door jamb reinforcing devices mentioned heretofore and many novel features that result in a new reinforcing device which is not anticipated, rendered obvious, suggested, or even implied by any of the prior art door jamb reinforcing devices, either alone or in any combination thereof.

It is another object of the present invention to provide a new reinforcing device which may be easily and efficiently manufactured and marketed.

It is a further object of the present invention to provide a new reinforcing device which is of a durable and reliable construction.

An even further object of the present invention is to provide a new reinforcing device which is susceptible of a low cost of manufacture with regard to both materials and labor, and which accordingly is then susceptible of low prices of sale to the consuming public, thereby making such reinforcing device economically available to the buying public.

Still yet another object of the present invention is to provide a new reinforcing device which provides in the apparatuses and methods of the prior art some of the advantages thereof, while simultaneously overcoming some of the disadvantages normally associated therewith.

Still another object of the present invention is to provide a new reinforcing device for reinforcing the union of a metal door jamb (or frame) and a hinge of an attached door for helping prevent the bending and breaking of the door jamb and the sagging of the door from the weight of the door, especially on a metal door jamb.

Yet another object of the present invention is to provide a new reinforcing device which includes a plate having front and back surfaces, a pair of opposite ends, and a pair of sides extending between the ends. The plate has a plurality of spaced apart holes extending therethrough between the front and back surfaces. The holes are adapted for coaxial alignment with corresponding fastener holes of a leaf of a hinge. The plate is adapted for attachment to a structure over a leaf of a hinge fastened to the structure such that the leaf of the hinge is interposed between the structure and the plate.

Still yet another object of the present invention is to provide a new reinforcing device that is especially useful for preventing the hinges of heavy doors on steel door jambs from pulling away from the door jamb.

Even still another object of the present invention is to provide a new reinforcing device that helps prevent door sag do to loosely secured hinges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
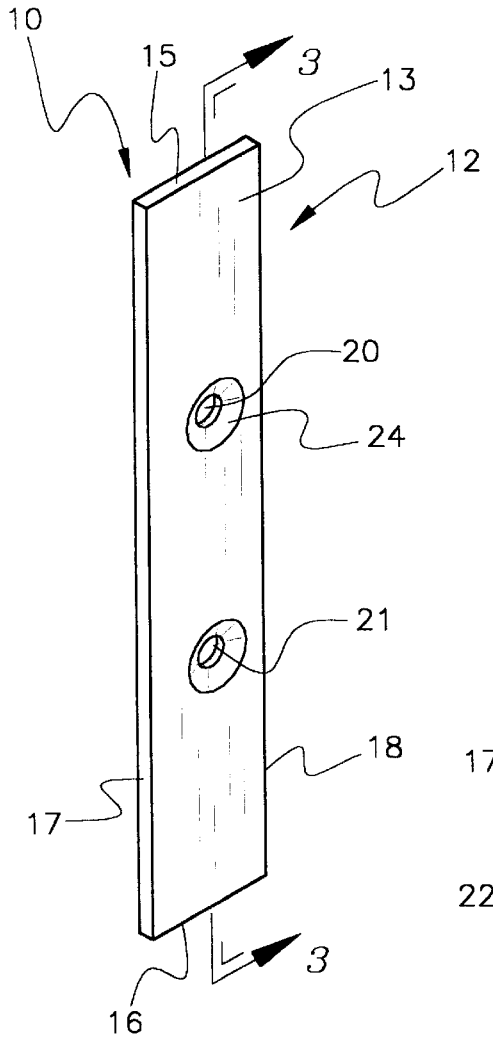
FIG. 1 a schematic perspective view of a new reinforcing device according to the present invention.

With reference now to the drawings, and in particular to FIGS. 1 through 7 thereof, a new reinforcing device embodying the principles and concepts of the present invention and generally designated by the reference numeral 10 will be described.

As best illustrated in FIGS. 1 through 7, the reinforcing device 10 generally comprises a plate 12 having front and back surfaces 13,14, a pair of opposite ends 15,16, and a pair of sides 17,18 extending between the ends 15,16. The plate 12 has a plurality of spaced apart holes 20,21 extending therethrough between the front and back surfaces 13,14. The holes 20,21 are adapted for coaxial alignment with corresponding fastener holes of a leaf 3 of a hinge 1. The plate 12 is adapted for attachment to a structure over a leaf 3 of a hinge 1 fastened to the structure such that the leaf 3 of the hinge 1 is interposed between the structure and the plate 12.

In use, the reinforcing device 10 is designed for a hinge 1 fastened to a structure, in particular to a metal (ideally steel door jamb). The hinge 1 has a pair of leaves 2,3 which are pivotally coupled together by a pivot pin inserted into the knuckles of the leaves. Each of the leaves has a plurality of fastening holes extending therethrough.

In closer detail, the plate 12 is generally rectangular and has substantially planar front and back surfaces 13,14, a pair of opposite ends 15,16, and a pair of sides 17,18 extending between the ends 15,16. The plate 12 has a length defined between the ends 15,16. The plate 12 has a width defined between the sides 17,18. The plate 12 also has a thickness between the front and back surfaces 13,14. Ideally, the width is less than about one-fifth the length. In an ideal illustrative embodiment, the length is less than about 6 inches and width is less than about 1 and $1/16^{th}$ inches. Ideally, the thickness in this illustrative embodiment is less than about $1/8^{th}$ inch.

Figure 3:
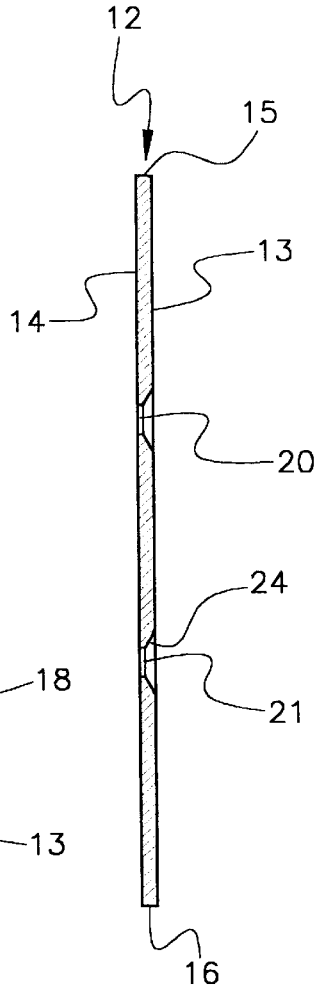
FIG. 3 is a schematic cross sectional view of the present invention taken from line 3—3 of FIG. 1.
Figure 4:
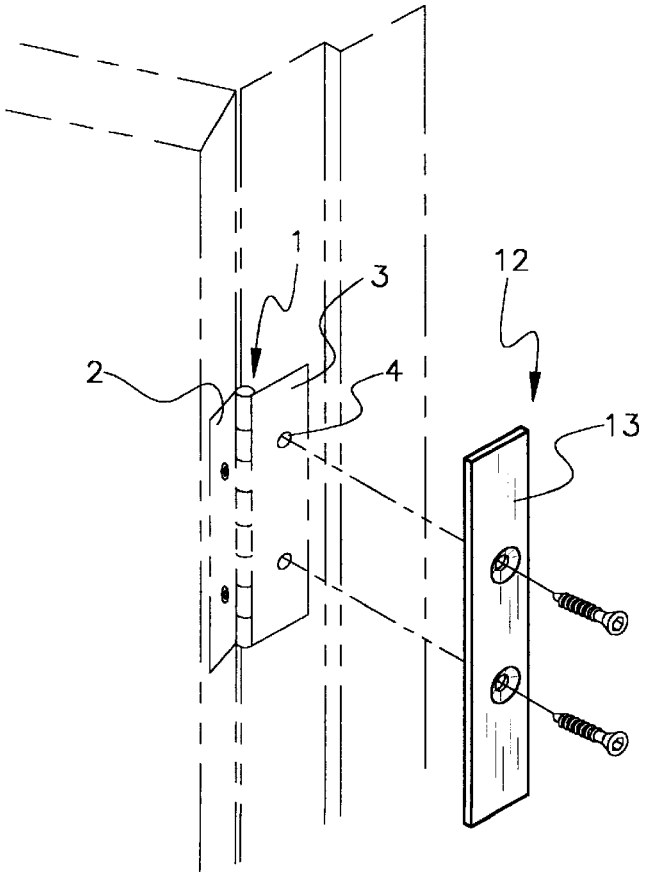
FIG. 4 is a schematic perspective view of the present invention in use reinforcing a hinge of a door.

With reference to FIGS. 1, 3, and 4, the plate 12 has a plurality of spaced apart holes 20,21 extending therethrough between the front and back surfaces 13,14. Preferably, each of holes has a countersink portion 24 located adjacent the front surface 13. As illustrated in FIG. 4, the holes are adapted for coaxial alignment with corresponding fastener holes of a leaf 3 of a hinge 1. The countersink portions 24 are for receiving therein the head of a fastener inserted into the hole to keep the head of the fastener flush with the front surface 13 when screwed into the door jamb.

Figure 2:
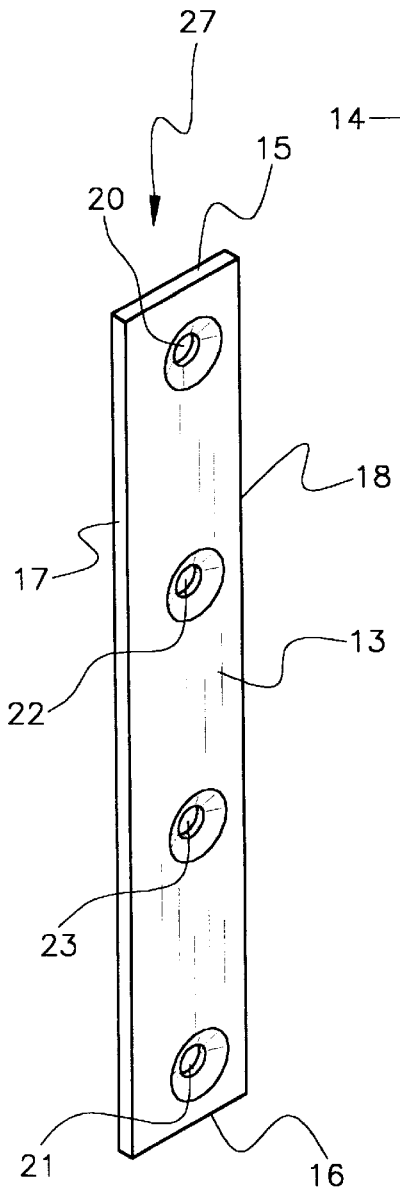
FIG. 2 is a schematic side view of the preferred embodiment of the present invention.
Figure 2A:
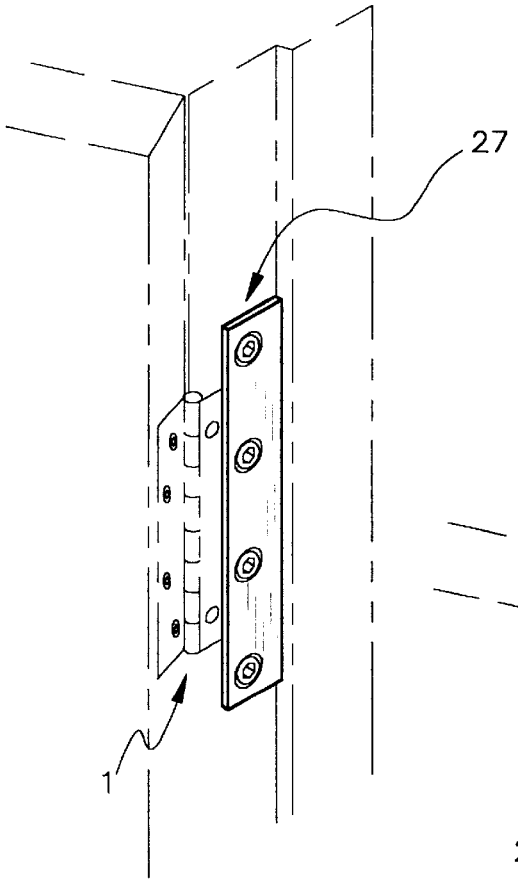
FIG. 2*a* is a schematic perspective view of the additional embodiment of the present invention in use mounted to a door jamb and door.

With reference to FIGS. 2 and 2A, in an additional embodiment 27, the plate 12 has four holes 20,21,22,23, each positioned adjacent one of the sides 17 of the plate 12. One of the holes 20 is positioned adjacent one of the ends 15 of the plate 12, while another holes 21 is positioned adjacent the other end 16 of the plate 12. A third and fourth of the holes 22,23 are adapted for coaxial alignment with corresponding fastener holes of a leaf 3 of a hinge 1.

As illustrated in FIGS. 1 and 4, the plate 12 is adapted for attachment to a structure over a leaf 3 of a hinge 1 fastened to the structure such that the leaf 3 of the hinge 1 is interposed between the structure and the plate 12. Preferably, the back surface 14 of the plate 12 faces the structure when the plate is attached to the structure.

Figure 5:
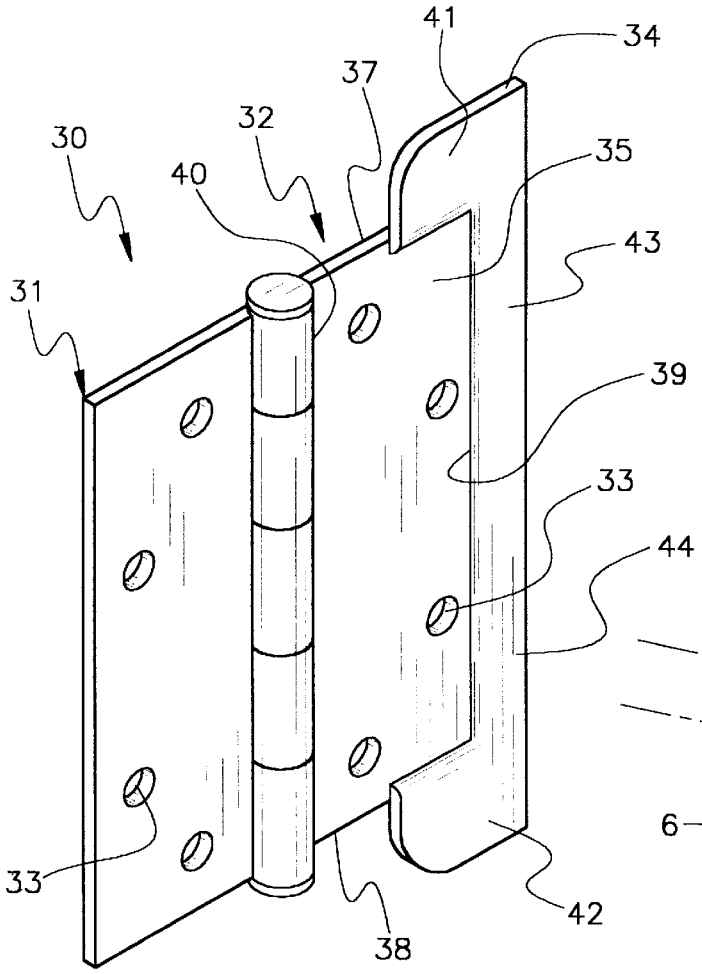
FIG. 5 is a schematic front perspective view of the hinge embodiment of the present invention.
Figure 6:
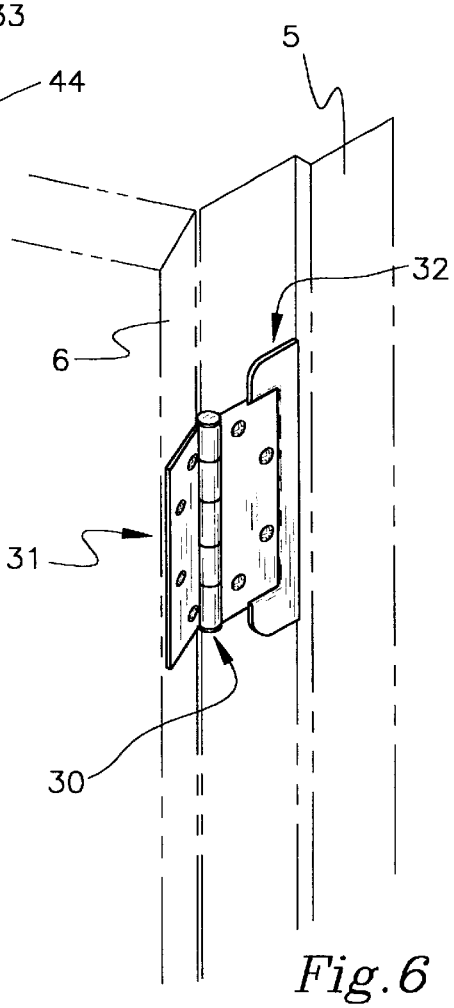
FIG. 6 is a schematic perspective view of the hinge embodiment the present invention in use attached to a door and a door jamb.
Figure 7:
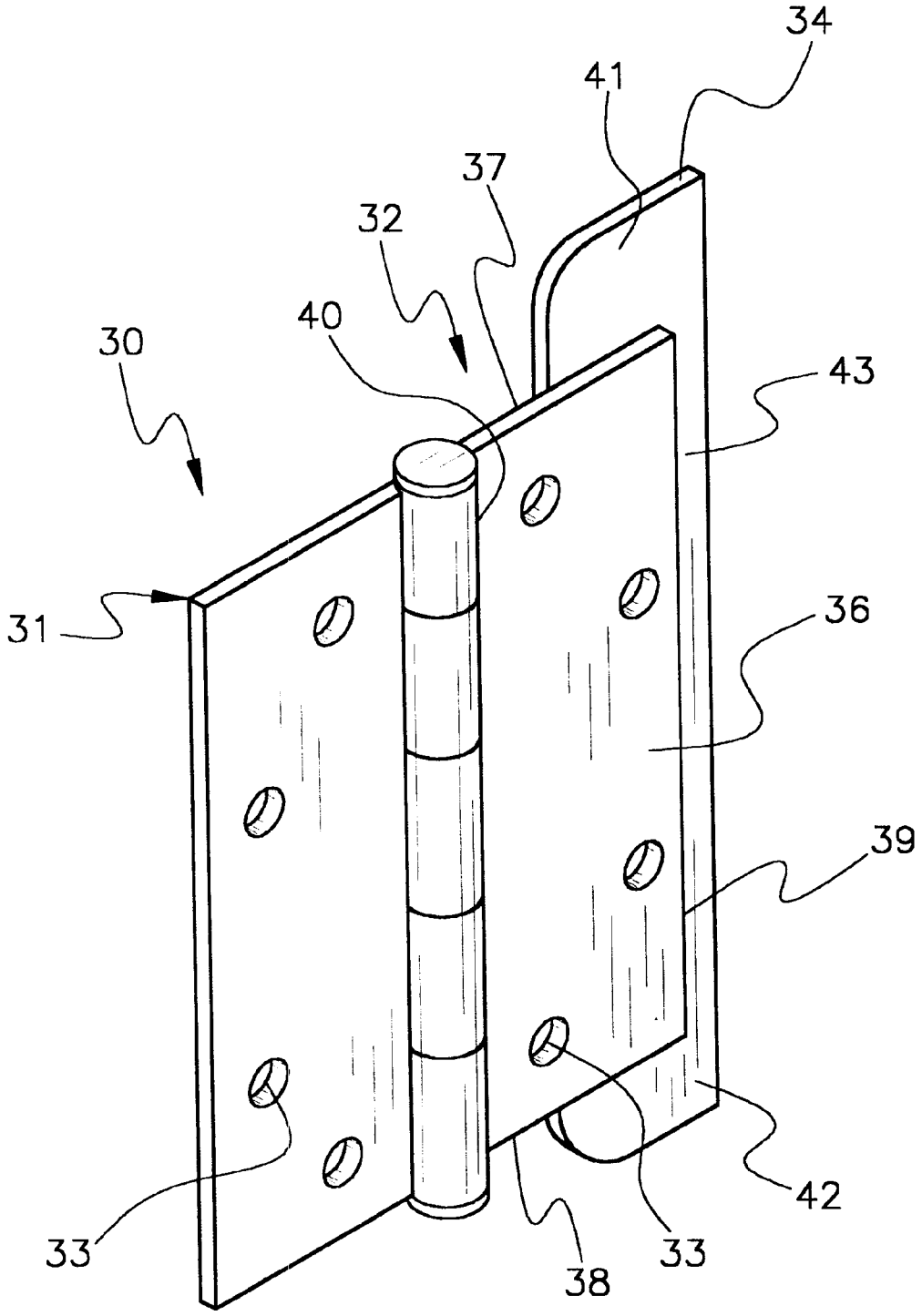
FIG. 7 is a schematic back perspective view of the hinge embodiment of the present invention rotated about a lower end of the hinge.

As illustrated in FIGS. 5 and 6, in an additional optional embodiment, the device comprises a reinforced hinge 30 for reinforcing the union of a metal door jamb 5 to a door 6. The reinforce hinge 30 embodiment includes a pair of leaves 31,32 each being generally rectangular and each having front and back faces, a pair of sides and a pair of ends, and a plurality of fastening holes 33 extending therethrough. The leaves 31,32 are pivotally coupled together along a pair of adjacent sides to permit pivoting of the leaves to a position where the front faces of the leaves generally face each other. The back face of a first leaf 31 of the pair of leaves is adapted for attachment to a side of a door 6. The back face 36 of a second leaf 32 of the pair of leaves is adapted for attachment to a hinge attachment plate adjacent a hinge leaf accepting recess or mortise in a typical metal door jamb 5.

The front face 35 of the second leaf 32 has a flange plate 34 coupled thereto preferably by a bead weld. The flange plate 34 has a pair of generally rectangular end portions 41,42, and a generally rectangular side portion 43 connecting the end portions 41,42 of the flange plate 34 together. The side portion 43 of the flange plate 34 is outwardly extended along the side 39 of the second leaf distal the pivotally coupled side 40 of the second leaf 32. One of the end portions 41 of the flange plate 34 is outwardly extended from one of the ends 37 of the second leaf 32. Another of the end portions 42 of the flange plate 34 is outwardly extended from another of the ends 38 of the second leaf 32. Each of the end portions 41,42 of the flange plate 34 has a length extending in a direction from the side portion 43 of the flange plate 34 towards the pivotally coupled side 40 of the second leaf 32.

Preferably, the lengths of the end portions 41,42 of the flange plate 34 extend from the side portion 43 of the flange plate 34 to a midpoint on the associated end 37,38 of the second leaf 32 generally equidistant between the sides 39,40 of the second leaf 32. Preferably, the flange plate 34 generally lies in a plane generally parallel to the front face 35 of the second leaf 32. The flange plate 34 has a front outer face 44 spaced apart from the front face 35 of the second leaf 32. In use, the flange plate 34 is designed for abutting against the door jamb 5 around the hinge mortise of the door jamb to reinforce the union of the door hinge to the door jamb 5 to prevent bending and buckling of the door jamb 5 from the weight of the attached door 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reinforced hinge for reinforcing a union of a metal door jamb to a door, comprising:

a pair of leaves, each of the leaves being generally rectangular and each having front and back faces, a pair of sides and a pair of ends, and a plurality of fastening holes extending therethrough, said leaves being pivotally coupled together along adjacent sides to permit pivoting of said leaves to a position where said front faces of said leaves generally face each other;

said back face of a first leaf of said pair of leaves being adapted for attachment to a side of a door;

said back face of a second leaf of said pair of leaves being adapted for attachment to a hinge attachment plate adjacent a hinge leaf accepting recess in a metal door jamb;

said front face of said second leaf having a flange plate coupled thereto;

said flange plate having a pair of generally rectangular end portions, and a generally rectangular side portion connecting said end portions of said flange plate together;

said side portion of said flange plate being outwardly extended along the side of said second leaf distal the pivotally coupled side of said second leaf;

one of said end portions of said flange plate being outwardly extended from one of said ends of said second leaf, another of said end portions of said flange plate being outwardly extended from another of said ends of said second leaf;

each of said end portions of said flange plate having a length extending in a direction from said side portion of said flange plate towards the pivotally coupled side of said second leaf;

wherein said lengths of said end portions of said flange plate extend from said side portion of said flange plate to a midpoint on the associated end of the second leaf generally equidistant between said sides of said second leaf;

said flange plate generally lying in a plane generally parallel to said front face of said second leaf, said flange plate having a front outer face spaced apart from said front face of said second leaf; and said flange plate being for abutting against the door jamb to reinforce the union of the door hinge to the door jamb.

2. A reinforced hinge for reinforcing a union of a metal door jamb to a door, comprising:

a pair of leaves, each of the having front and back faces, a pair of sides and a pair of ends, and a plurality of fastening holes extending therethrough, said leaves being pivotally coupled together along adjacent sides to permit pivoting of said leaves to a position where said front faces of said leaves generally face each other;

said back face of a first leaf of said pair of leaves being adapted for attachment to a side of a door;

said back face of a second leaf of said pair of leaves being adapted for attachment to a hinge attachment plate adjacent a hinge leaf accepting recess in a metal door jamb; and said front face of said second leaf having a flange plate coupled thereto, said flange plate being for abutting against the door jamb to reinforce the union of the door hinge to the door jamb;

wherein said flange plate has a pair of generally rectangular end portions, and a generally rectangular side portion connecting said end portions of said flange plate together:

wherein each of said end portions of said flange plate has a length extending in a direction from said side portion of said flange plate towards the pivotally coupled side of said second leaf; and wherein said lengths of said end portions of said flange plate extend from said side portion of said flange plate to a midpoint on the associated end of the second leaf generally equidistant between said sides of said second leaf.

3. The reinforced hinge as set forth in claim 2, wherein said side portion of said flange plate is outwardly extended along the side of said second leaf distal the pivotally coupled side of said second leaf.

4. The reinforced hinge as set forth in claim 2, wherein one of said end portions of said flange plate is outwardly extended from one of said ends of said second leaf.

5. The reinforced hinge as set forth in claim 4, wherein another of said end portions of said flange plate is outwardly extended from another of said ends of said second leaf.

6. The reinforced hinge as set forth in claim 2, wherein said flange plate generally lies in a plane generally parallel to said front face of said second leaf, said flange plate having a front outer face spaced apart from said front face of said second leaf.

* * * * *